US009980622B2

(12) United States Patent
Soller et al.

(10) Patent No.: US 9,980,622 B2
(45) Date of Patent: May 29, 2018

(54) CLEANING DEVICE HAVING A VARIABLE SIZE AND SHAPE HEAD

(71) Applicant: S. C. Johnson & Son, Inc., Racine, WI (US)

(72) Inventors: Douglas A. Soller, Racine, WI (US); Steven A. Zach, Waterford, WI (US); Jose M. Arevalo, Racine, WI (US); Matthew J. Forst, Oak Creek, WI (US); Jeffrey L. Crull, McFarland, WI (US); Katlyn Ross, Madison, WI (US); Evan A. Sparks, Madison, WI (US); Aaron Marion, Trevor, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 668 days.

(21) Appl. No.: 13/936,595

(22) Filed: Jul. 8, 2013

(65) Prior Publication Data

US 2014/0007367 A1 Jan. 9, 2014

Related U.S. Application Data

(60) Provisional application No. 61/669,552, filed on Jul. 9, 2012.

(51) Int. Cl.
*A47L 13/46* (2006.01)
*A47L 13/258* (2006.01)

(52) U.S. Cl.
CPC ..... *A47L 13/46* (2013.01); *A47L 13/258* (2013.01)

(58) Field of Classification Search
CPC ..... A47L 13/20; A47L 13/24; A47L 13/254; A47L 13/256; A47L 13/257
USPC ..... 15/147.2, 228, 231
See application file for complete search history.

(56) References Cited

U.S. PATENT DOCUMENTS

| | | | | |
|---|---|---|---|---|
| 3,760,450 A | | 9/1973 | Griffin et al. | |
| 3,877,103 A | | 4/1975 | Nash | |
| 4,845,800 A | | 7/1989 | Pederson et al. | |
| 4,991,250 A | | 2/1991 | Young | |
| 5,218,734 A | * | 6/1993 | Sacks | A47L 13/258 15/147.1 |

(Continued)

FOREIGN PATENT DOCUMENTS

| | | |
|---|---|---|
| CA | 2703657 A1 | 6/2009 |
| CN | 201098094 Y | 8/2008 |

(Continued)

OTHER PUBLICATIONS

PCT/US2013/049655 International Search Report and Written Opinion dated Apr. 3, 2014.

*Primary Examiner* — Christopher M Koehler
*Assistant Examiner* — Stephanie Berry

(57) ABSTRACT

A cleaning device includes a base having a first side and a second side. A first deployment element pivotally connects to the first side of the base and is pivotable from a stowed position to a deployed position. A second deployment element pivotally connects to the second side of the base and is pivotable from the stowed position to the deployed position. In the stowed position the base, the first deployment element, and the second deployment element define a substantially rectangular perimeter. In the deployed position, the base, the first deployment element, and the second deployment element define a substantially trapezoidal perimeter.

17 Claims, 18 Drawing Sheets

(56) References Cited

U.S. PATENT DOCUMENTS

| | | | |
|---|---|---|---|
| 5,876,141 | A | 3/1999 | Hsu |
| D409,133 | S | 5/1999 | Henry |
| 5,953,784 | A | 9/1999 | Suzuki et al. |
| D423,742 | S | 4/2000 | Kingry et al. |
| 6,047,435 | A | 4/2000 | Suzuki et al. |
| 6,098,239 | A | 8/2000 | Vosbikian |
| 6,305,046 | B1 | 10/2001 | Kingry et al. |
| 6,484,346 | B2 | 11/2002 | Kingry et al. |
| 6,651,290 | B2 | 11/2003 | Kingry et al. |
| 6,842,936 | B2 | 1/2005 | Policicchio et al. |
| D593,268 | S | 5/2009 | Weis |
| D599,969 | S | 9/2009 | Weis |
| D617,066 | S | 6/2010 | Koenig et al. |
| D657,928 | S | 4/2012 | Byrne |
| D660,536 | S | 5/2012 | Weaver et al. |
| 8,276,234 | B2 | 10/2012 | Hsu |
| 8,356,379 | B2 | 1/2013 | Fischer |
| 2004/0011382 | A1 | 1/2004 | Kingry et al. |
| 2004/0158947 | A1* | 8/2004 | Sie ..... A47L 13/144 15/119.2 |
| 2006/0048318 | A1* | 3/2006 | Goh ..... A47L 11/12 15/97.1 |
| 2006/0085935 | A1* | 4/2006 | White, II ..... A47L 13/258 15/228 |
| 2006/0230567 | A1* | 10/2006 | Harper ..... B25G 3/38 15/228 |
| 2007/0151063 | A1* | 7/2007 | Decoopman ..... A47L 13/254 15/231 |
| 2011/0167583 | A1* | 7/2011 | Weaver ..... A47L 13/256 15/231 |

FOREIGN PATENT DOCUMENTS

| | | | |
|---|---|---|---|
| EP | 1764025 | A1 | 3/2007 |
| FR | 2735347 | A1 | 12/1996 |
| JP | H10286208 | A | 10/1998 |
| WO | 9704701 | A1 | 2/1997 |
| WO | 0200819 | A1 | 1/2002 |
| WO | 2009068160 | A1 | 6/2009 |

* cited by examiner

CLEANING DEVICE HAVING A VARIABLE SIZE AND SHAPE HEAD

CROSS-REFERENCE TO RELATED APPLICATIONS

This application claims priority from U.S. Patent Application No. 61/669,552 filed Jul. 9, 2012.

STATEMENT REGARDING FEDERALLY SPONSORED RESEARCH/DEVELOPMENT

Not applicable.

BACKGROUND OF THE INVENTION

1. Field of the Invention

This invention generally relates to cleaning devices that support disposable cleaning sheets, and more particularly cleaning devices having variable size and shape heads for mounting disposable cleaning sheets.

2. Description of the Related Art

Previous floor cleaning devices, such as mops and the like, have been provided with cleaning heads that include multiple folding or collapsing sections. With such a structure, the cleaning surface area of the head may be varied. This permits these cleaning devices to be used in various areas, such as on narrow stairs, under furniture and appliances, in living rooms, and the like.

However, a need still exists for a cleaning device having a variable size and shape head. Furthermore, a need also exists for a cleaning device in which the size and shape of the head are relatively easily varied.

BRIEF SUMMARY OF THE INVENTION

The foregoing needs are met with a cleaning device according to the invention having a variable size and shape mop head.

In one aspect, the cleaning device includes a base, a first deployment element, a second deployment element, a first biasing device, a second biasing device, and a release mechanism. The base has a first side and an opposed second side. The first deployment element is pivotally connected to the first side of the base and is pivotable from a first stowed position to a first deployed position. The second deployment element is pivotally connected to the second side of the base and is pivotable from a second stowed position to a second deployed position. The first biasing device engages the base and the first deployment element, and the first biasing device biases the first deployment element towards the first deployed position. The second biasing device engages the base and the second deployment element, and the second biasing device biases the second deployment element towards the second deployed position. The release mechanism is supported by the base. The release mechanism engages the first deployment element to hold the first deployment element in the first stowed position, and the release mechanism engages the second deployment element to hold the second deployment element in the second stowed position. The release mechanism is manually actuatable to disengage the first deployment element and disengage the second deployment element thereby permitting the first biasing device to move the first deployment element to the first deployed position and permitting the second biasing device to move the second deployment element to the second deployed position.

In one embodiment, the cleaning device further includes a foam layer positioned on the base. The foam layer may include surface protrusions arranged in a plurality of lines. The surface protrusions may have a larger surface area in a central line of the plurality of lines.

In another embodiment, the cleaning device further includes a plurality of attachment structures for retaining a cleaning sheet wherein the attachment structures are located on a top surface of the base. The attachment structures may comprise a flexible material having slits defining pointed structures capable of engaging a cleaning sheet.

In another embodiment, the first deployment element includes a passageway for receiving one of the attachment structures when the first deployment element is in the first stowed position, and/or the second deployment element includes a passageway for receiving one of the attachment structures when the second deployment element is in the second stowed position. The first deployment element may be flush with a top surface of the base when the first deployment element is in the first stowed position, and/or the second deployment element may be flush with the top surface of the base when the second deployment element is in the second stowed position.

In one embodiment, the release mechanism comprises (i) a first arm for engaging the first deployment element to hold the first deployment element in the first stowed position, and (ii) a second arm for engaging the second deployment element to hold the second deployment element in the second stowed position, and (iii) an actuator button attached to the first arm and the second arm. The button can move a first end of the first arm toward a second end of the second arm when the button is depressed. The first end of the first arm can engage the first deployment element when the first deployment element is in the first stowed position, and the second end of the second arm can engage the second deployment element when the second deployment element is in the second stowed position.

In one embodiment, the first deployment element has a substantially triangular perimeter, and/or the second deployment element has a substantially triangular perimeter. The first deployment element may include a fastener for attaching a cleaning sheet, and/or the second deployment element may include a fastener for attaching a cleaning sheet.

In one embodiment, when the first deployment element is in the first stowed position and the second deployment element is in the second stowed position, the base, the first deployment element, and the second deployment element define a substantially rectangular perimeter, and when the first deployment element is in the first deployed position and the second deployment element is in the second deployed position, the base, the first deployment element, and the second deployment element define a substantially trapezoidal perimeter.

In one embodiment, when the first deployment element is in the first deployed position and the second deployment element is in the second deployed position, the base, the first deployment element, and the second deployment element define a perimeter having a leading edge and a trailing edge, the leading edge having a greater length than the trailing edge.

In another aspect, the cleaning device includes a base, a first deployment element, and a second deployment element. The base has a first side and an opposed second side. The first deployment element is pivotally connected to the first side of the base and is pivotable from a first stowed position to a first deployed position. The second deployment element is pivotally connected to the second side of the base and is pivotable from a second stowed position to a second deployed position. When the first deployment element is in the first stowed position and the second deployment element is in the second stowed position, the base, the first deployment element, and the second deployment element define a substantially rectangular perimeter, and when the first deployment element is in the first deployed position and the second deployment element is in the second deployed position, the base, the first deployment element, and the second deployment element define a substantially trapezoidal perimeter.

In one embodiment, the cleaning device further includes a first biasing device engaging the base and the first deployment element wherein the first biasing device biases the first deployment element towards the first deployed position; and a second biasing device engaging the base and the second deployment element wherein the second biasing device biases the second deployment element towards the second deployed position.

In another embodiment, the cleaning device further includes a release mechanism supported by the base. The release mechanism engages the first deployment element to hold the first deployment element in the first stowed position, ands the release mechanism engages the second deployment element to hold the second deployment element in the second stowed position. The release mechanism is manually actuatable to disengage the first deployment element and disengage the second deployment element thereby permitting the first biasing device to move the first deployment element to the first deployed position and permitting the second biasing device to move the second deployment element to the second deployed position. The release mechanism can include (i) a first arm for engaging the first deployment element to hold the first deployment element in the first stowed position, and (ii) a second arm for engaging the second deployment element to hold the second deployment element in the second stowed position, and (iii) an actuator button attached to the first arm and the second arm. The button moves a first end of the first arm toward a second end of the second arm when the button is depressed.

These and other features, aspects, and advantages of the present invention will become better understood upon consideration of the following detailed description and drawings.

BRIEF DESCRIPTION OF THE DRAWINGS

Like reference numerals will be used to refer to like parts from Figure to Figure in the following description of the drawings.

DETAILED DESCRIPTION OF THE INVENTION

Various embodiments of the invention will now be described with reference to the Figures. The embodiments are shown and described for the purposes of illustration and are not intended to limit the invention in any way. One non-limiting example embodiment of the invention described below provides a mop head having a variable size and shape head. However, more generally, the invention provides a variable size and shape support for a cleaning implement, wherein the support is adapted to receive a cleaning attachment such as a cleaning sheet.

Figure 1:
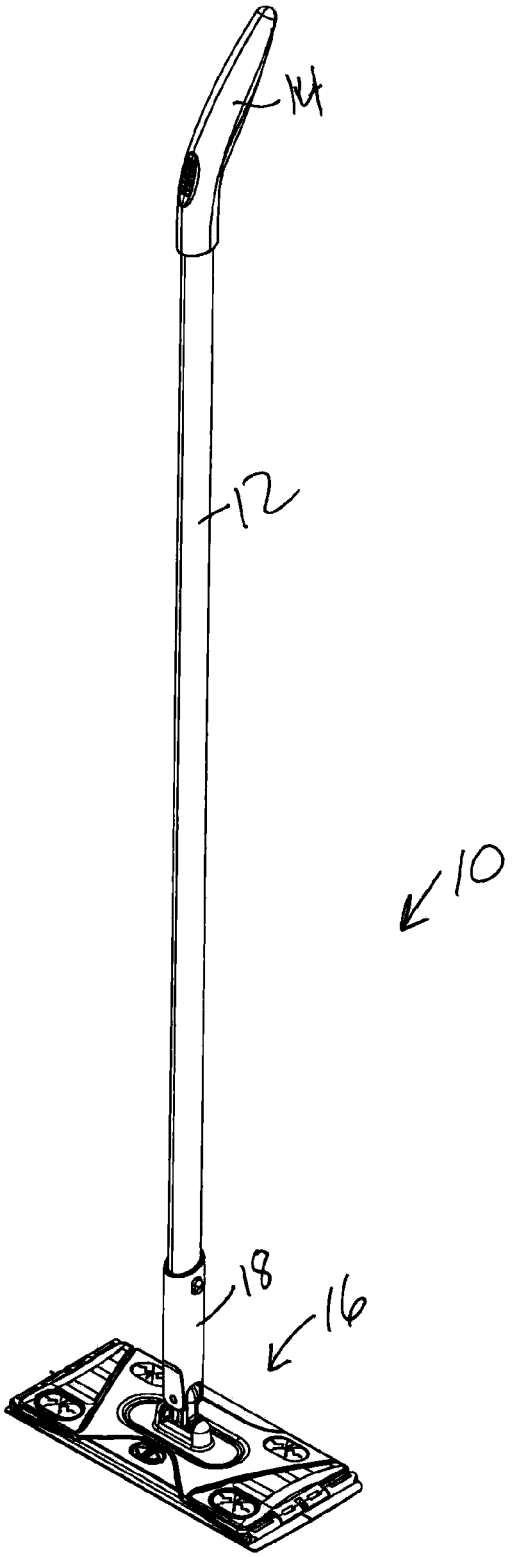
FIG. 1 is a perspective view of a cleaning device according to the present invention and illustrating deployable elements in a stowed position.
Figure 2:
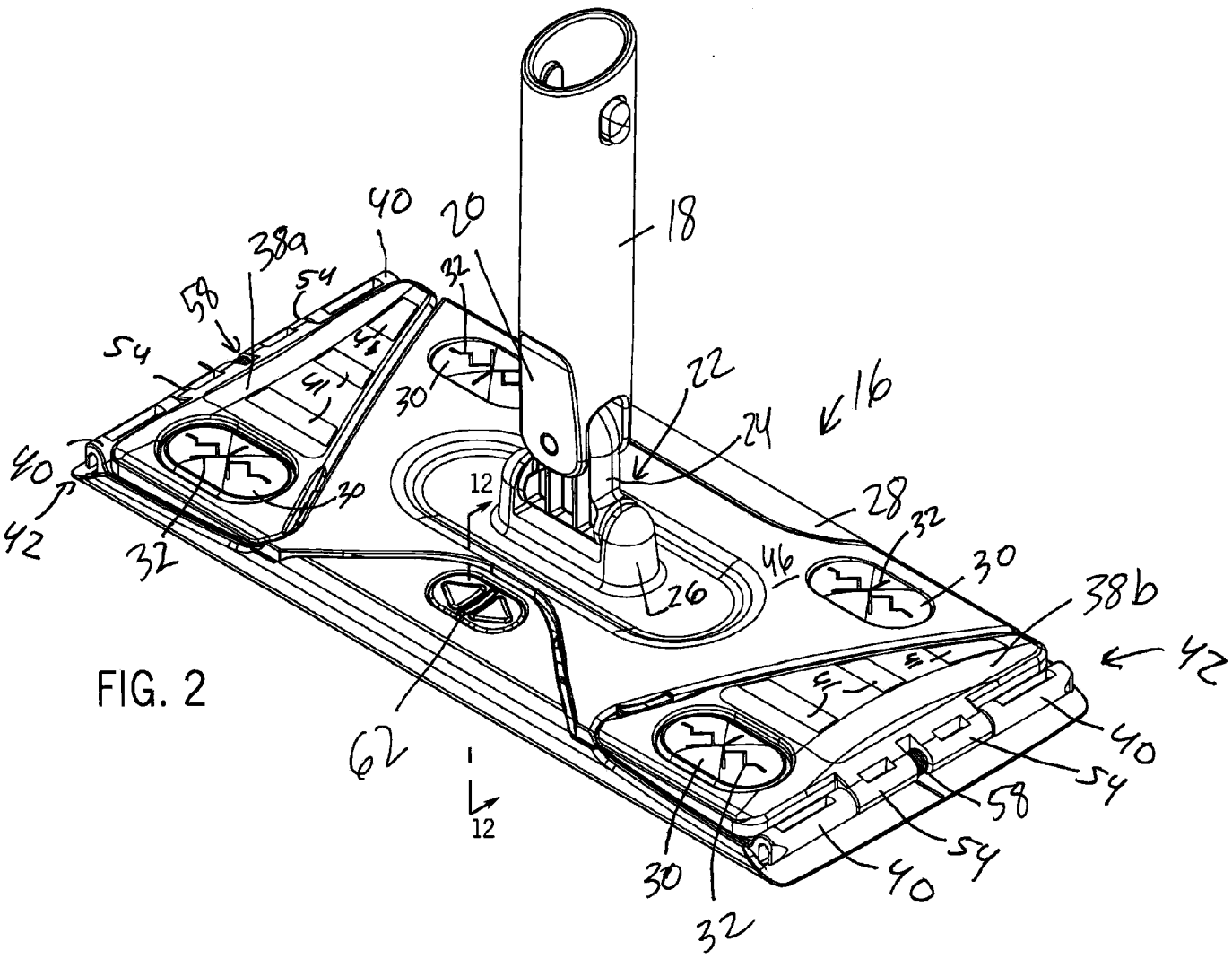
FIG. 2 is a top perspective view of a cleaning material-supporting head of the cleaning device of FIG. 1.

Referring now to the figures and particularly FIGS. 1 and 2, a cleaning device 10 according the present invention includes an elongated handle 12 that supports a grip 14 at one end. At the other end, the handle 12 connects to a cleaning material-supporting head 16. The size and shape of the head 16 (specifically, the size and shape of its perimeter) may be varied such that the cleaning device 10 is appropriate for use in different cleaning situations. These advantages and details of the head 16 are described in further detail below.

Figure 3:
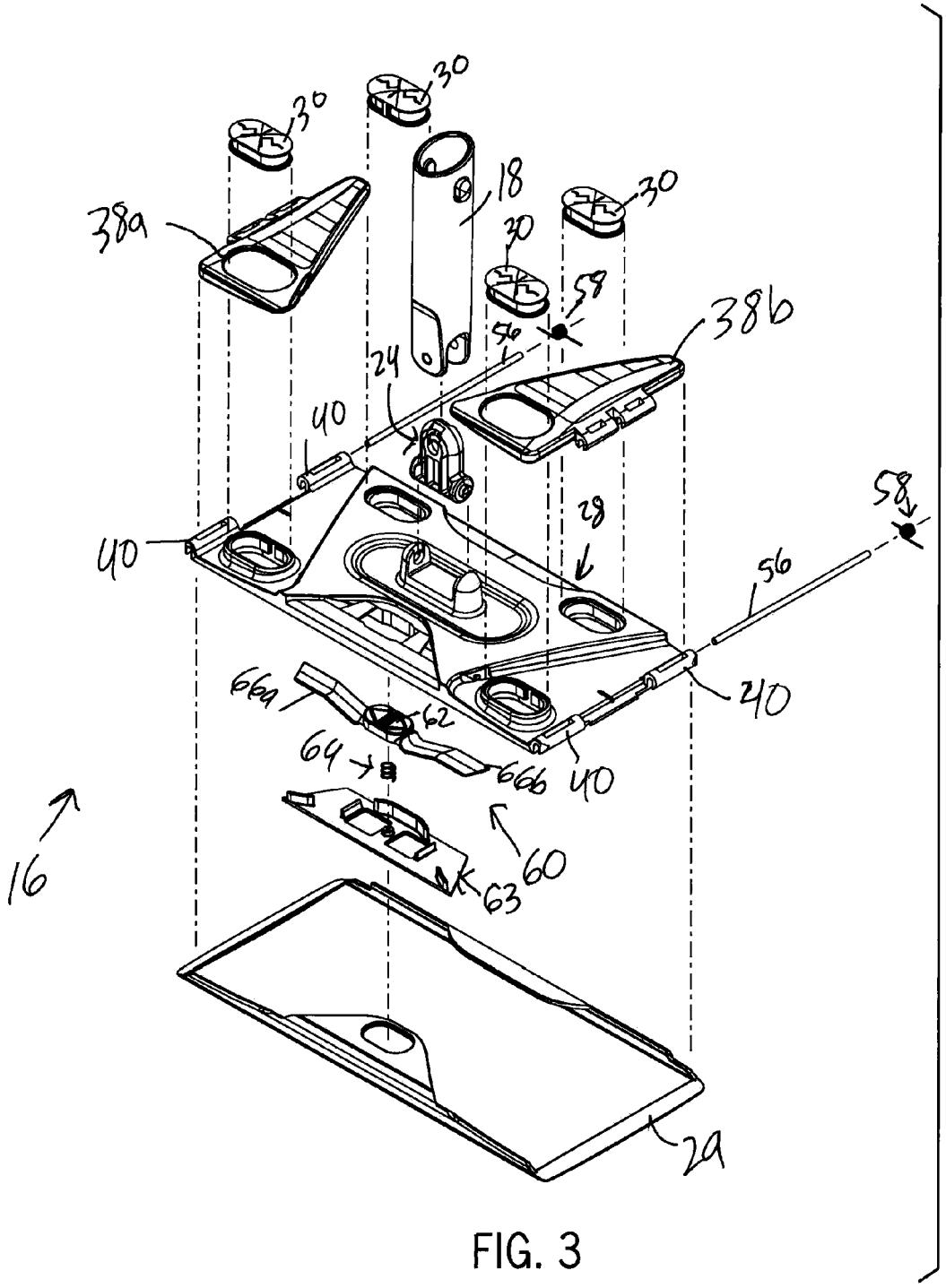
FIG. 3 is an exploded perspective view of the head of FIG. 2.

Turning now to FIGS. 2 and 3, the head 16 includes a handle connector 18 that detachably engages the handle 12. The handle connector 18 also includes a yoke 20 that defines, in part, a universal joint 22 that permits part of the head 16 to pivot relative to the handle 12. The universal joint 22 further includes a joint element 24 connected to the yoke 20 about a first axis, and a base yoke 26 about a second axis.

Figure 4:
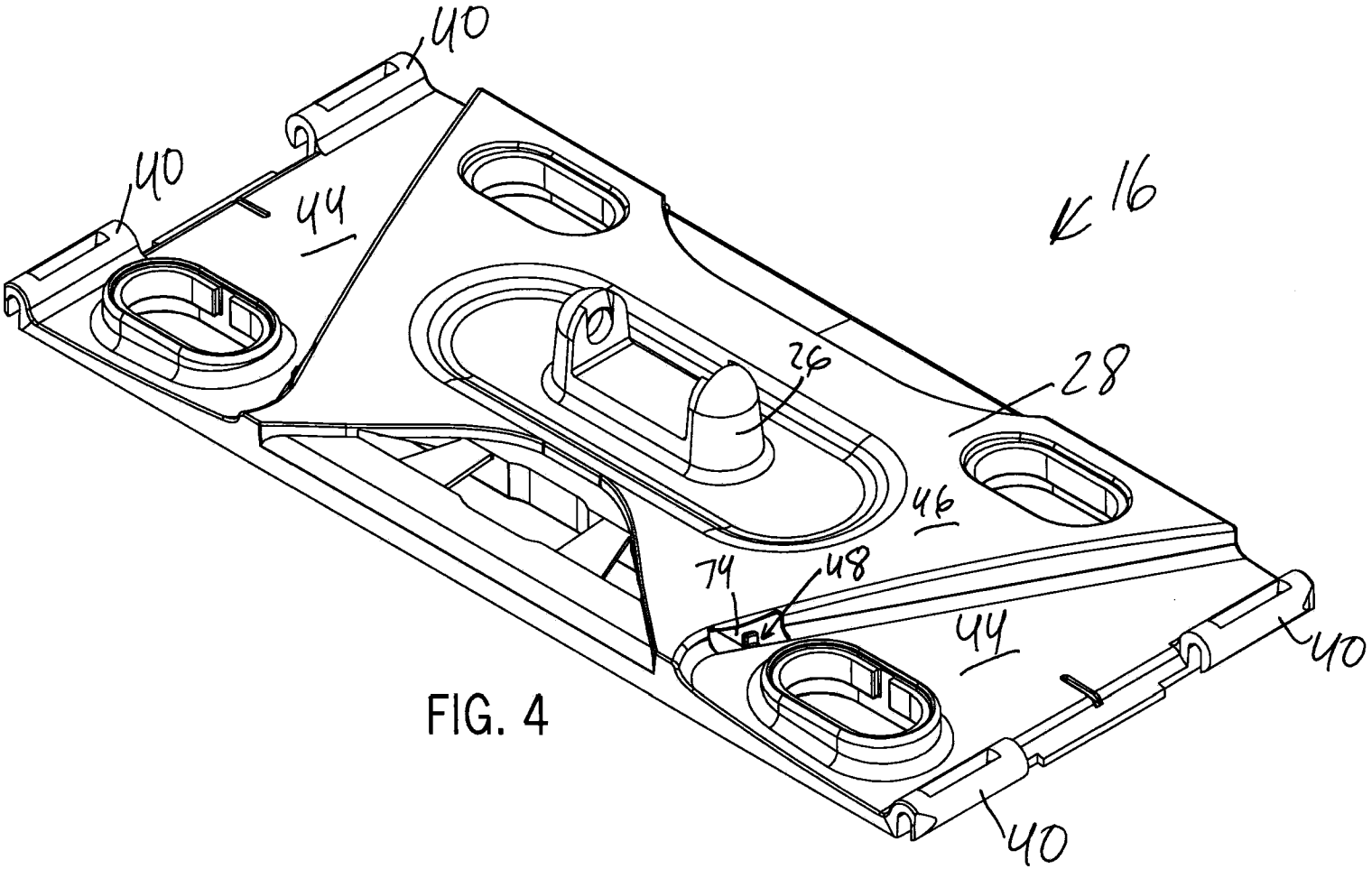
FIG. 4 is a top perspective view of an upper base of the head of FIG. 2.
Figure 5:
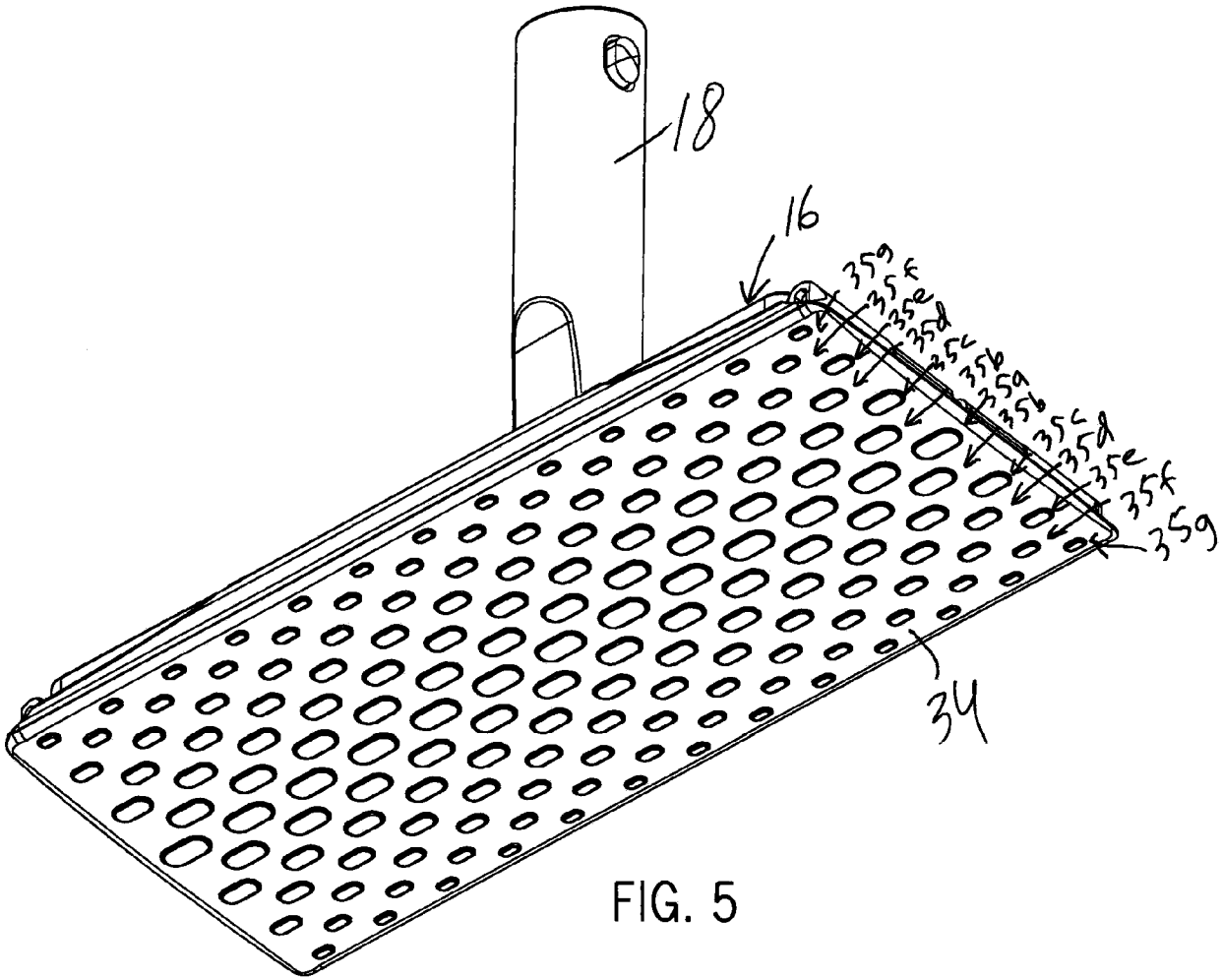
FIG. 5 is a bottom perspective view of the head of FIG. 2.
Figure 6:
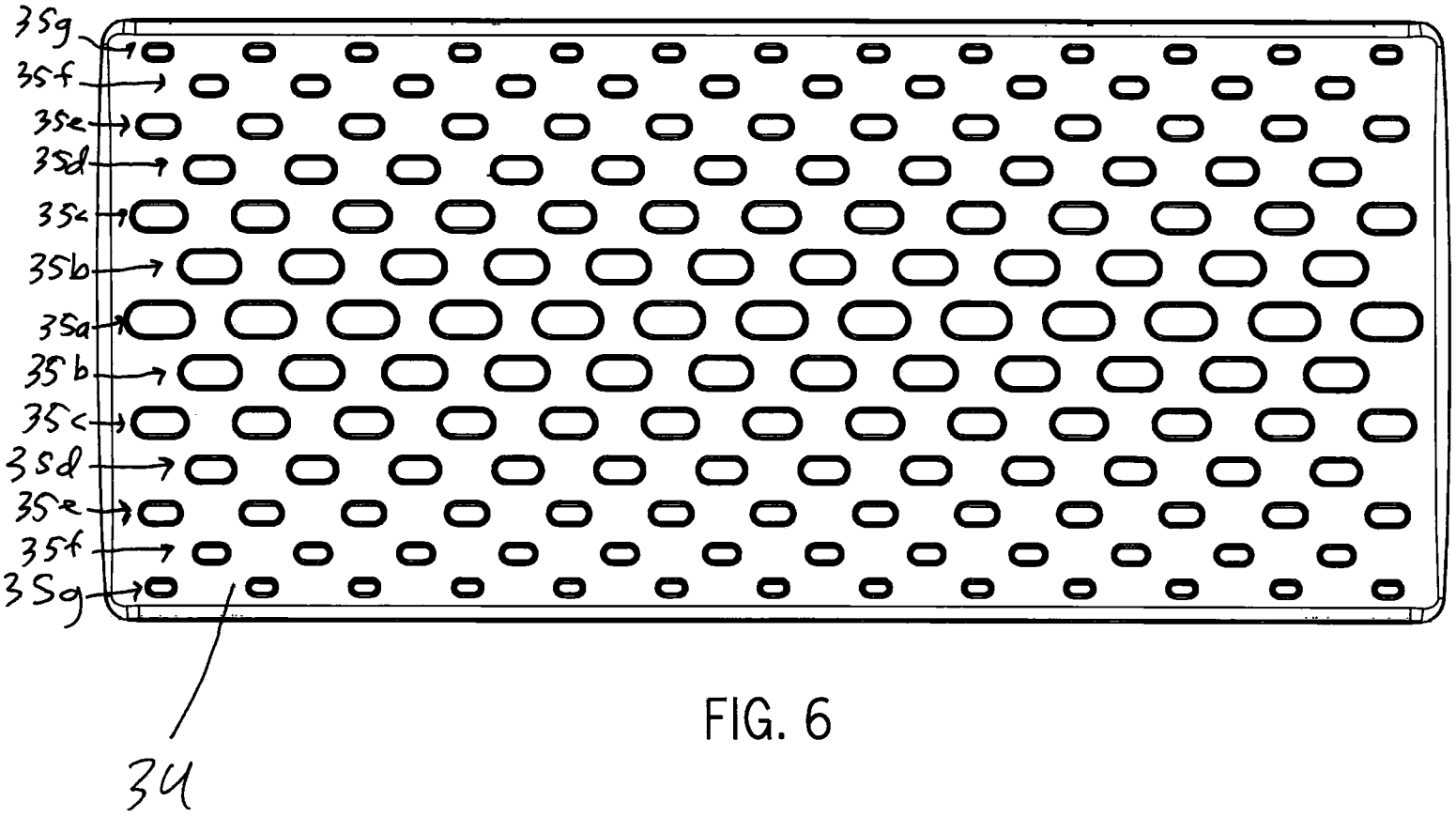
FIG. 6 is a bottom view of the head of FIG. 2.
Figure 10:
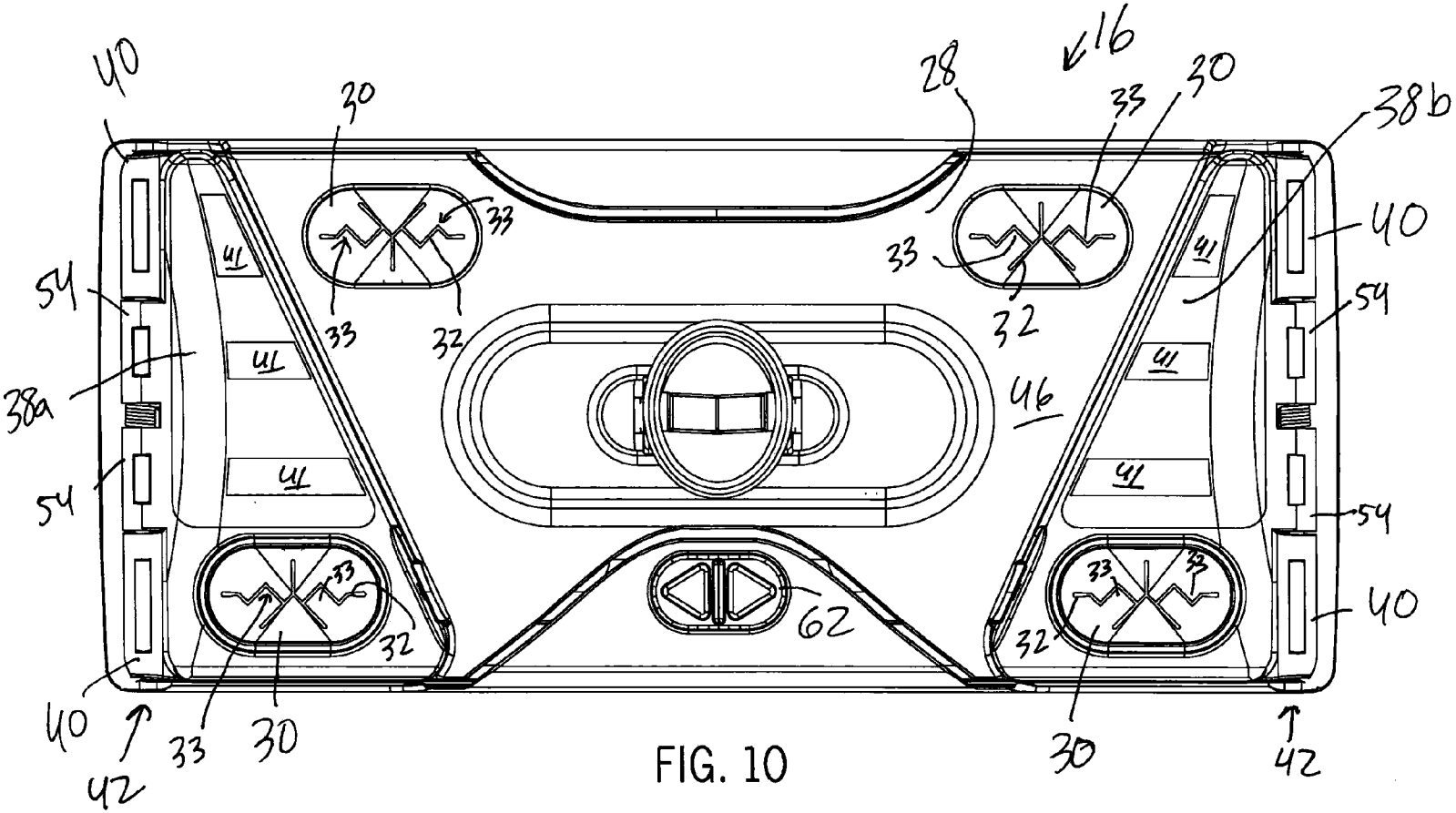
FIG. 10 is a top view of the head of FIG. 2.
Figure 11:
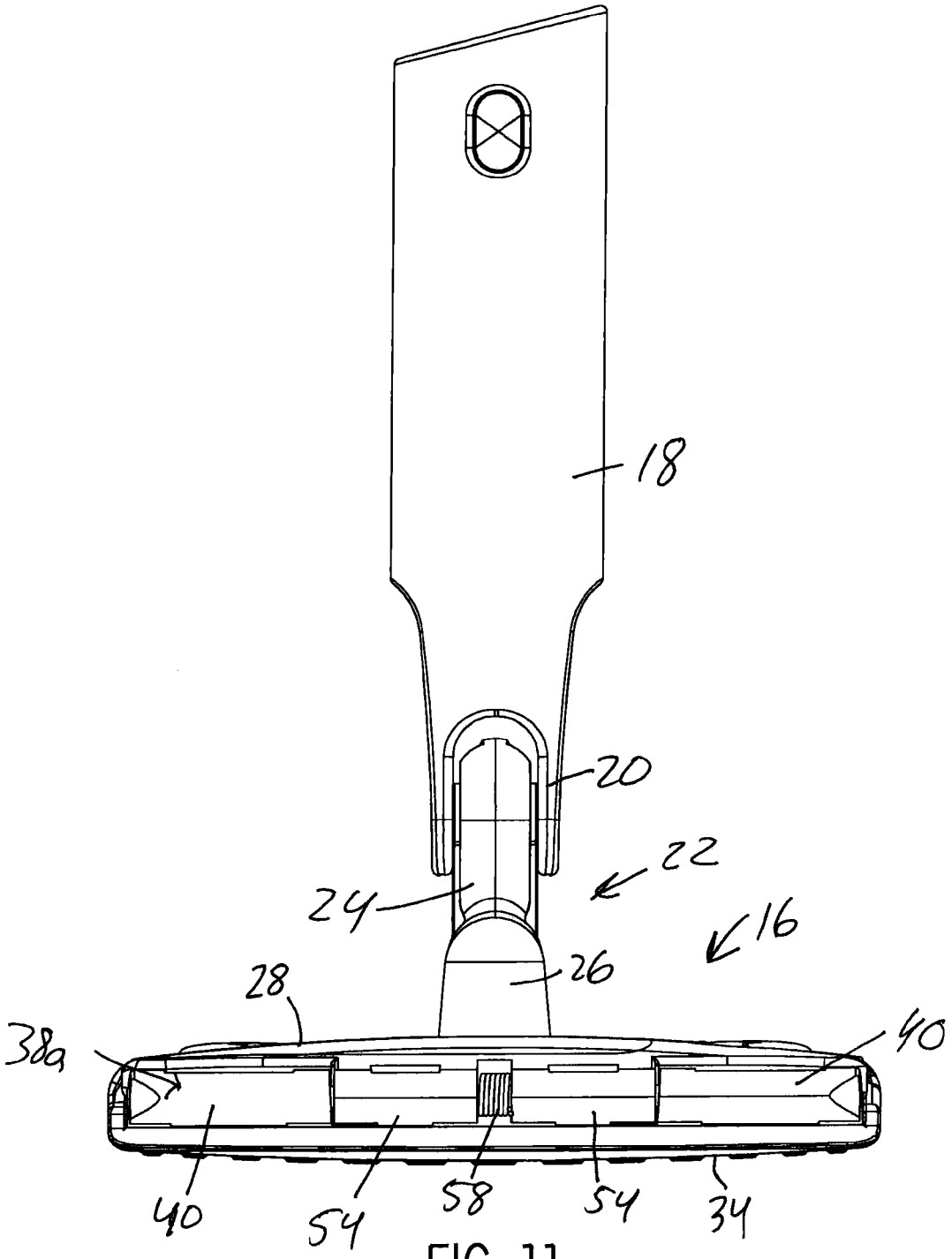
FIG. 11 is a side view of the head of FIG. 2.
Figure 12:
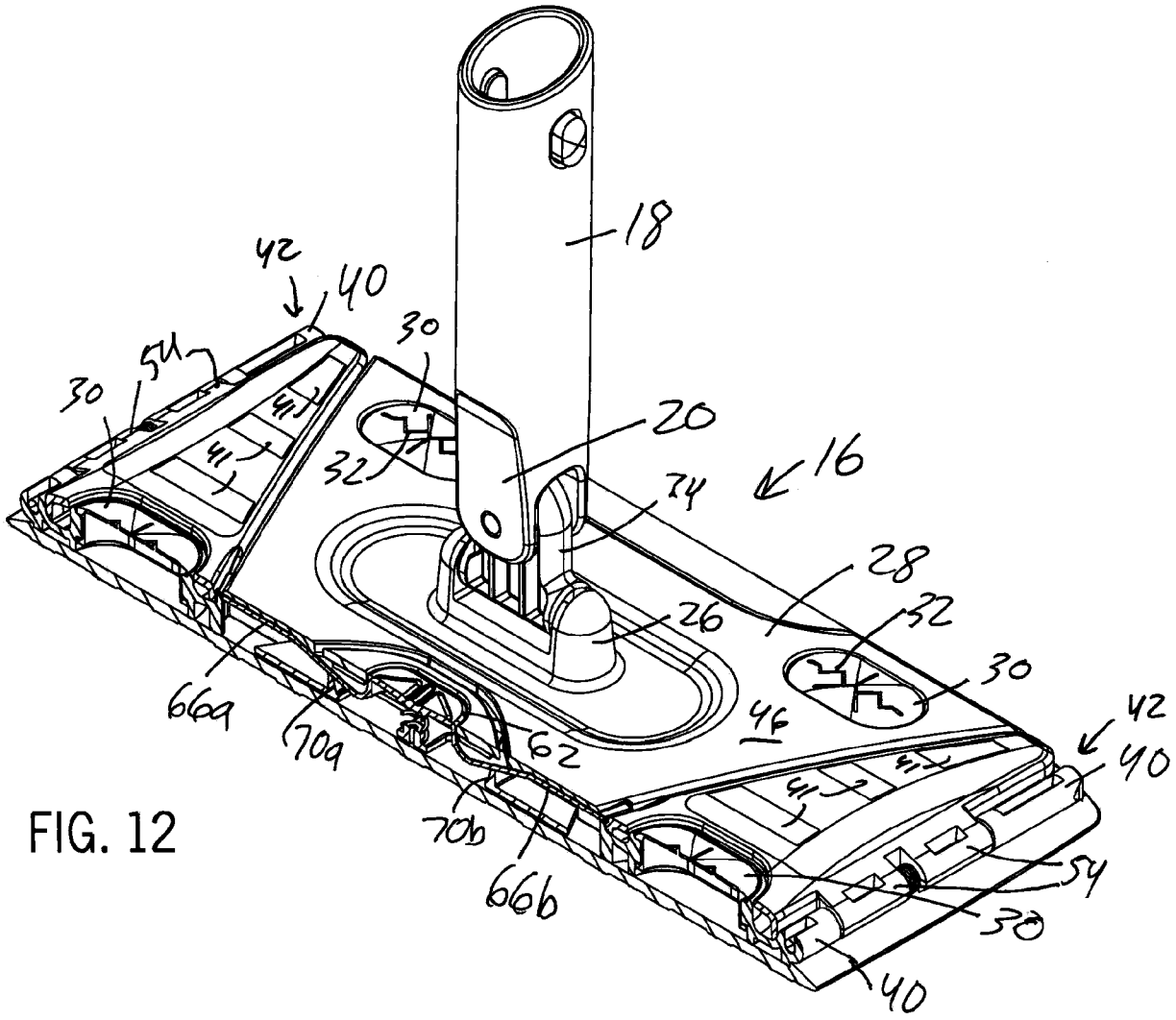
FIG. 12 is a perspective section view of the head of FIG. 2.
Figure 13:
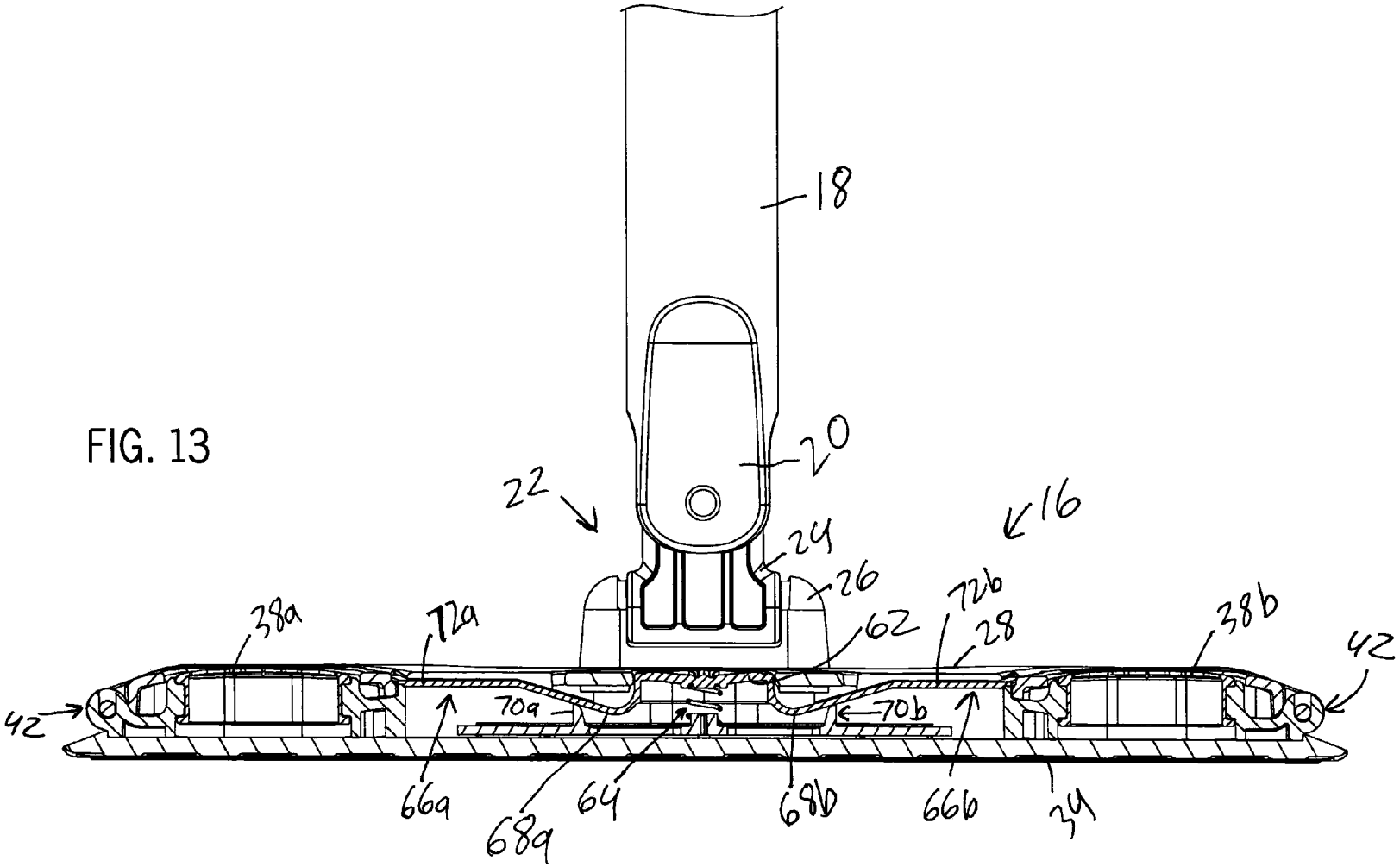
FIG. 13 is a front section view of the head of FIG. 2.
Figure 14:
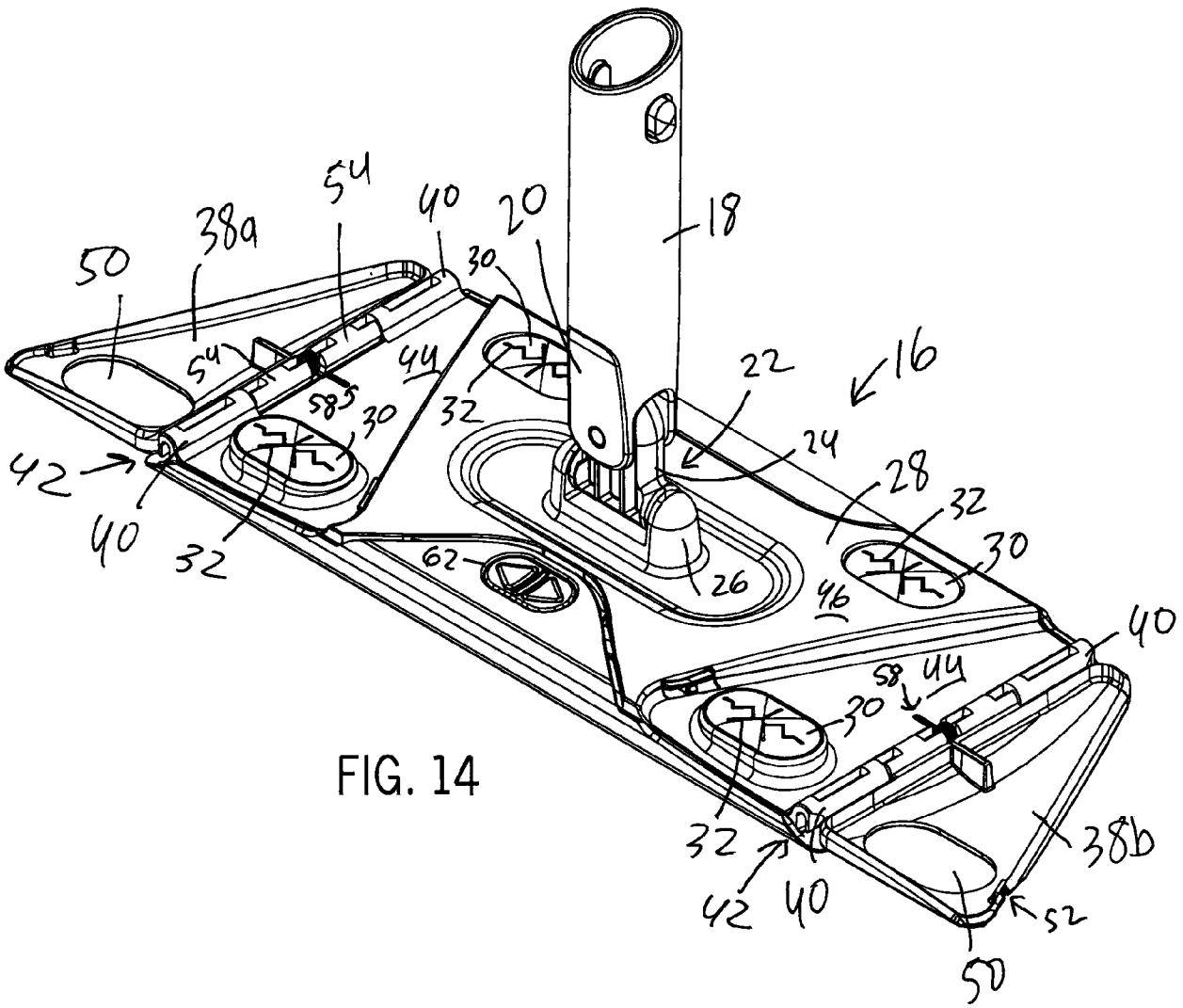
FIG. 14 is a top perspective view of the head of FIG. 2 illustrating the deployable elements in a deployed position.
Figure 15:
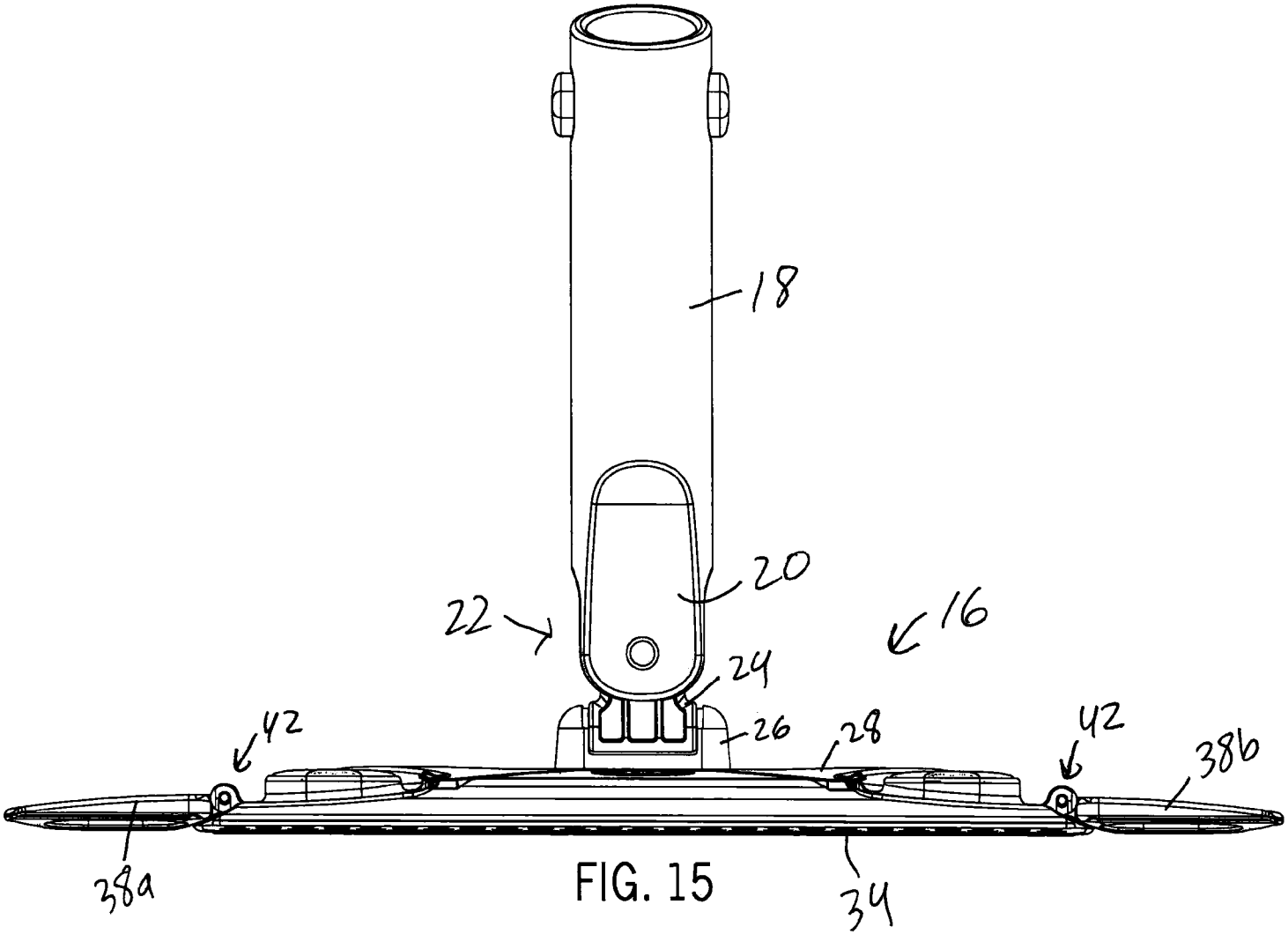
FIG. 15 is a front view of the head of FIG. 14.
Figure 16:
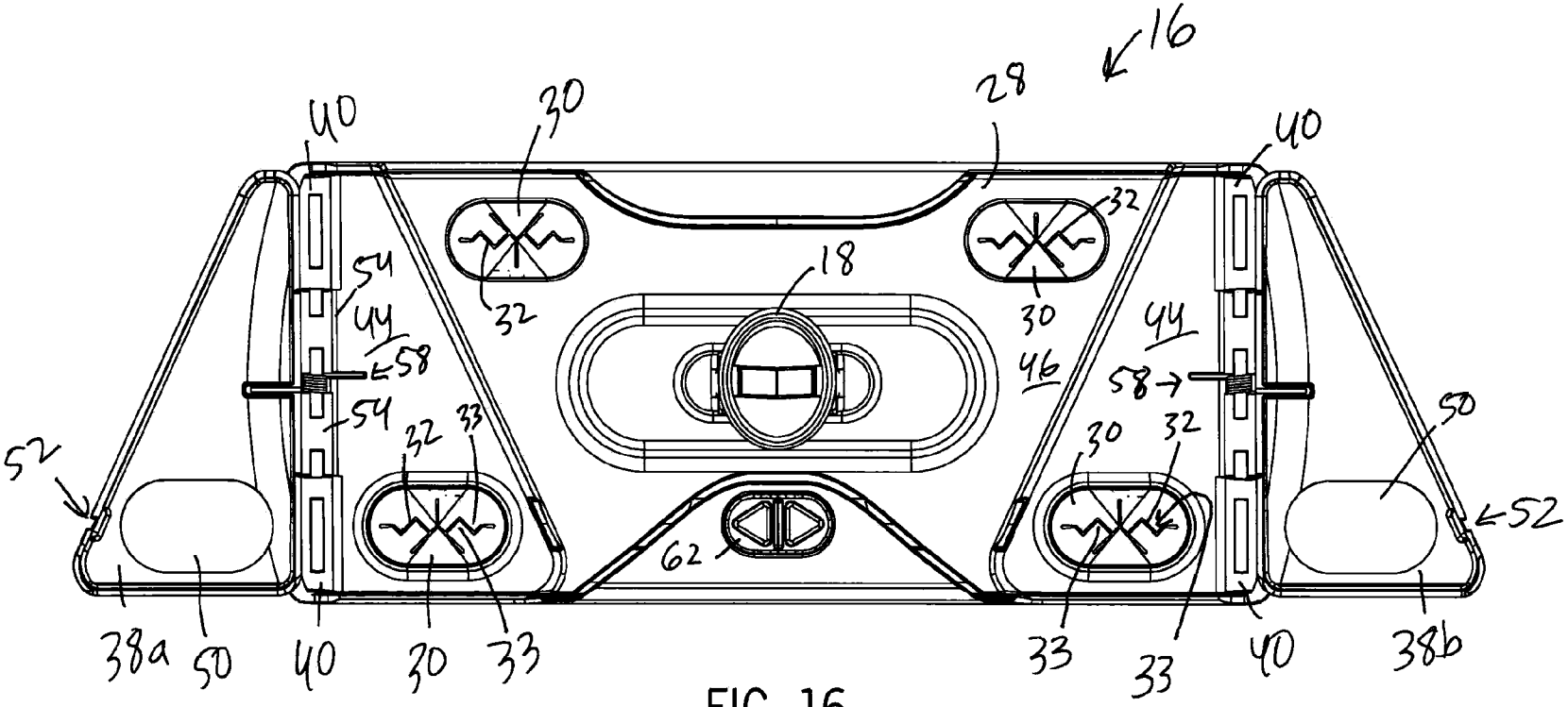
FIG. 16 is a top view of the head of FIG. 14.
Figure 17:
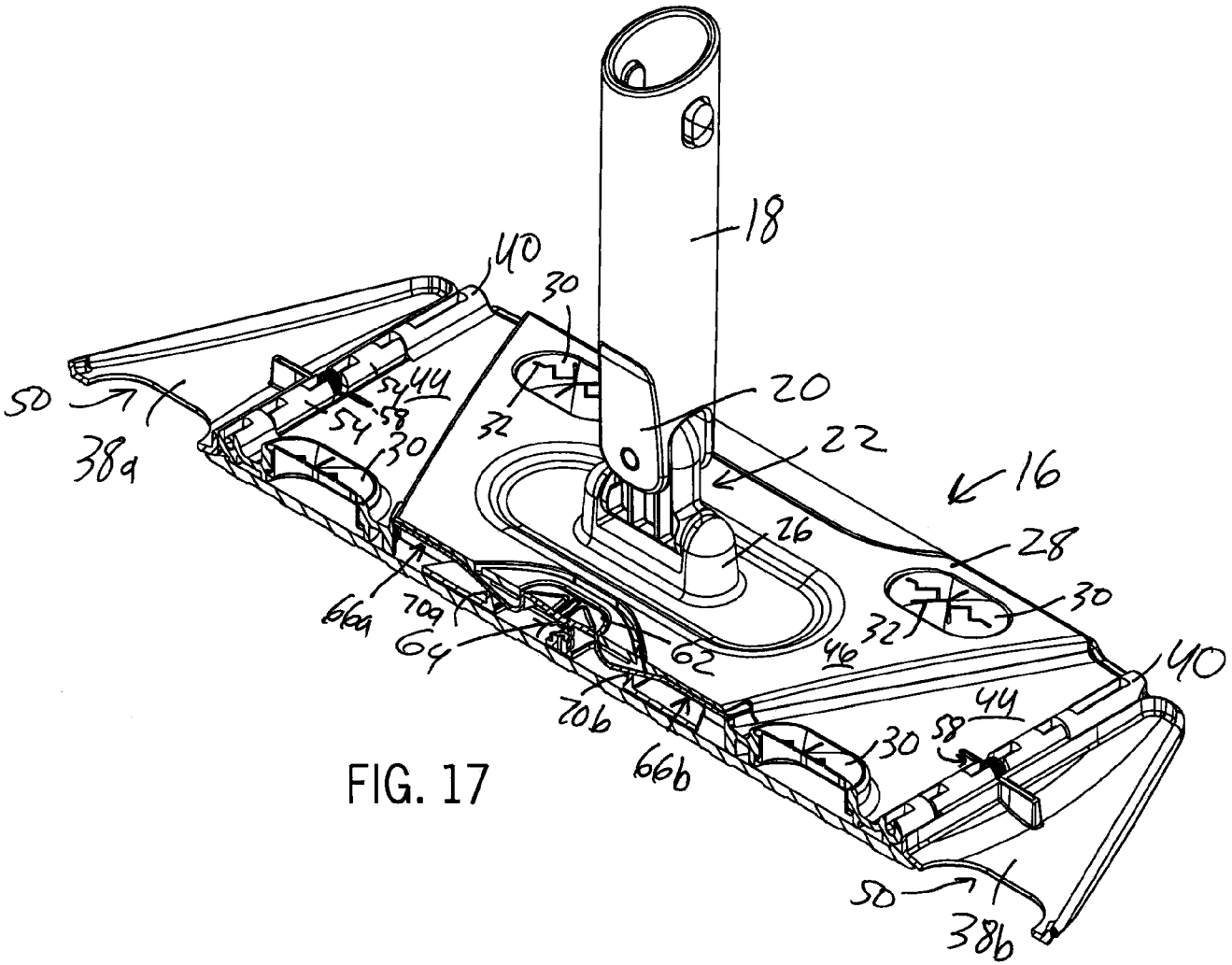
FIG. 17 is a perspective section view of the head of FIG. 14.
Figure 18:
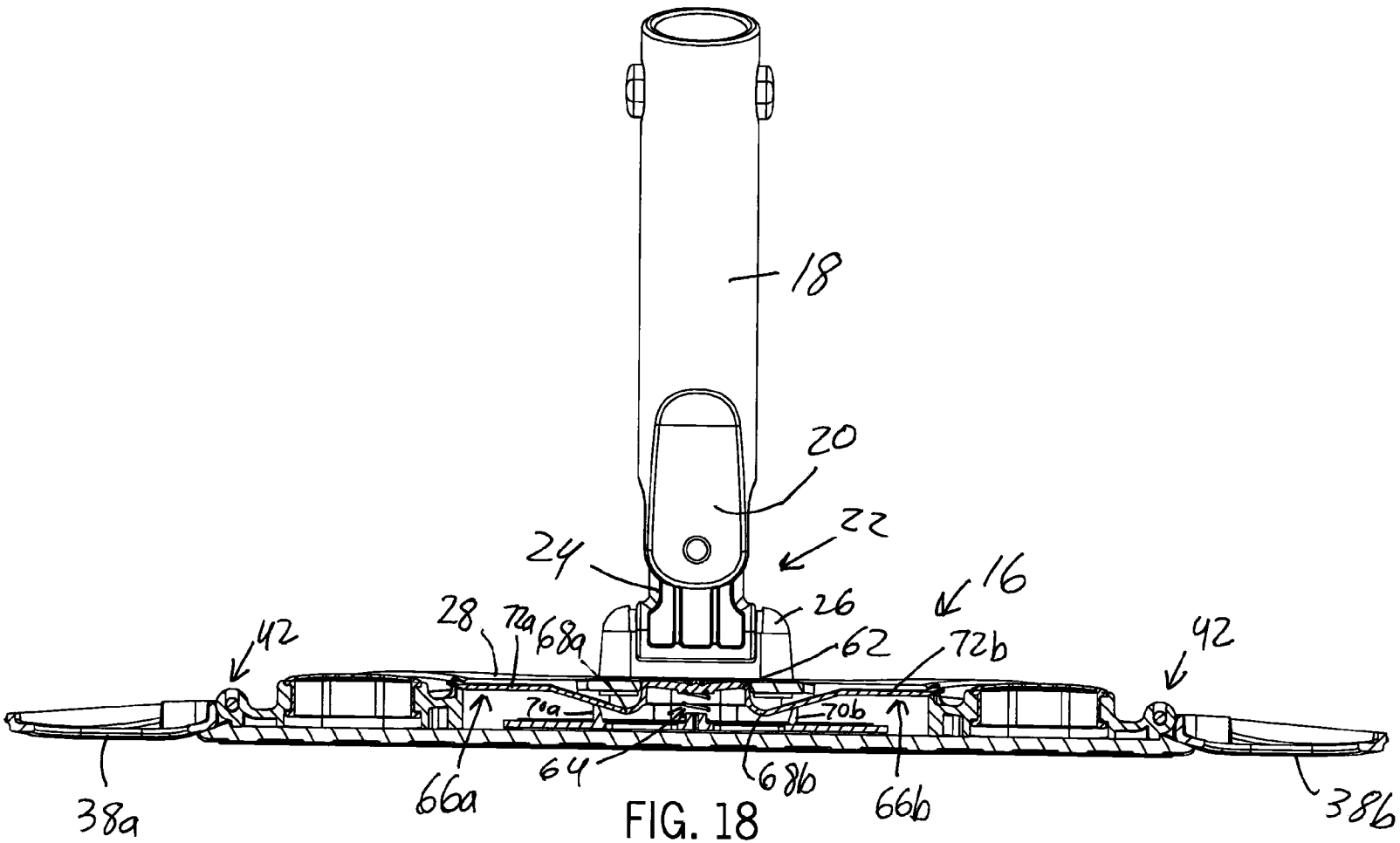
FIG. 18 is a front section view of the head of FIG. 14.

Referring to FIGS. 2-4, the base yoke 26 is part of an upper base 28. The upper base 28 attaches to a lower base 29 (see FIG. 3). The upper base 28 may receive an array of cleaning wipe attachment elements. In some configurations, each attachment element includes a flexible membrane 30 that has an array of outwardly-extending slits 32. Together, the slits 32 define pointed structures 33 (see FIG. 10) capable of engaging and holding a disposable cleaning wipe (not shown). In other configurations, the attachment elements may be one of the hook part or the loop part of a hook and loop fastener system such as that sold under the tradename Velcro™. Such a hook and loop fastener system is capable of engaging and holding the cleaning wipe. In any case, edges of the cleaning wipe engage the attachment elements and wrap under the head 16 to provide a cleaning surface.

Turning to FIGS. 2-6, opposite the attachment elements, the lower base 29 supports a foam layer 34 that has a substantially rectangular perimeter. The foam layer 34 includes oblong surface protrusions 35*a* to 35*g*. Protrusions 35*a* in a central line have the largest surface area of the protrusions. Protrusions 35*b* in two other lines have the second largest surface area of the protrusions. Protrusions 35*c* in two other lines have the third largest surface area of the protrusions. Protrusions 35*d* in two other lines have the fourth largest surface area of the protrusions. Protrusions 35*e* in two other lines have the fifth largest surface area of the protrusions. Protrusions 35*f* in two other lines have the sixth largest surface area of the protrusions. Protrusions 35*g* in two other lines have the smallest surface area of the protrusions. The protrusions 35*a* to 35*g* in the foam layer 34 improve the cleaning performance of the cleaning implement 10.

Referring to FIGS. 2-4, 7-11, and 14-16, the upper base 28 pivotably mounts two deployment elements or "wings" 38*a*, 38*b*. The deployment elements 38*a*, 38*b* are pivotable from a stowed position (that is, the position shown in FIGS. 1-13) to a deployed position (that is, the position shown in FIGS. 14-18). In the stowed position of one non-limiting embodiment, the base 28 and the deployment elements 38*a*, 38*b* together define a substantially rectangular perimeter with 10.5 inch long opposed sides and 4.5 inch opposed short sides. In the deployed position of this non-limiting embodiment, the base 28 and the deployment elements 38*a*, 38*b* together advantageously define a substantially trapezoidal perimeter with a 15 inch longest side and a distance of 4.5 inches measured along a line perpendicular to the inch longest side that extends from the 15 inch longest side to the opposed side that is parallel to the 15 inch longest side.

The upper base 28 includes several features to facilitate mounting the deployment elements 38*a*, 38*b*. Specifically, the sides of the upper base 28 include hinge elements 40 that define, in part, hinges 42 (see FIG. 2) about which the deployment elements 38*a*, 38*b* pivot relative to the upper base 28. Proximate the sides and the hinge elements 40, the upper base 28 also includes lower surfaces 44 (see FIG. 4) that are disposed below an intermediate upper surface 46. As such, when the deployment elements 38*a*, 38*b* are folded to the stowed position, the deployment elements 38*a*, 38*b* and the upper surface 46 provide a substantially continuous surface. In other words, the deployment element 38*a* is flush with the upper surface 46 when the deployment element 38*a* is in the stowed position, and the deployment element 38*b* is flush with the upper surface 46 when the deployment element 38*b* is in the stowed position. In addition, proximate the lower surfaces 44, the upper base 28 may include posts 48 (one of which is shown in FIG. 4) for engaging and facilitating alignment with the deployment elements 38*a*, 38*b*.

Figure 7:
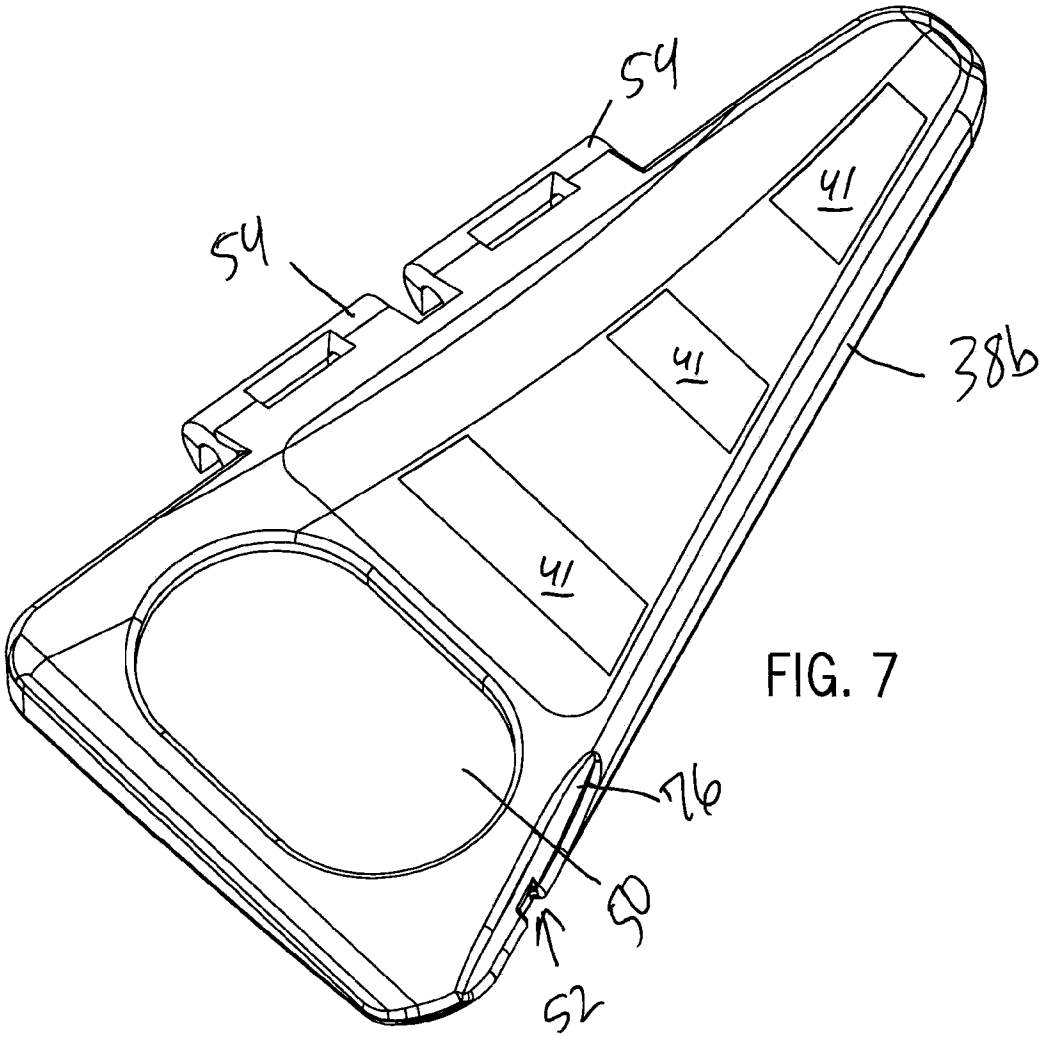
FIG. 7 is a top perspective view of a deployable element of the head of FIG. 2.
Figure 8:
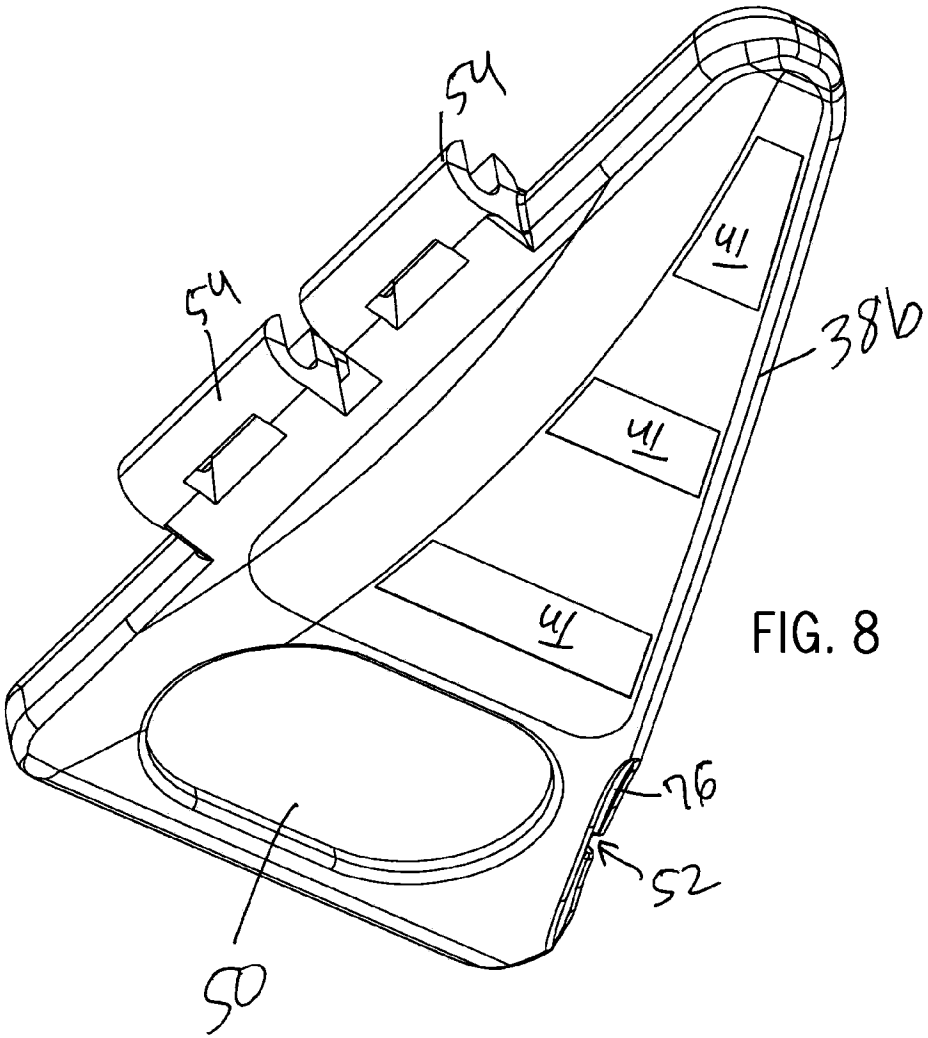
FIG. 8 is a bottom perspective view of the deployable element of FIG. 7.
Figure 9:
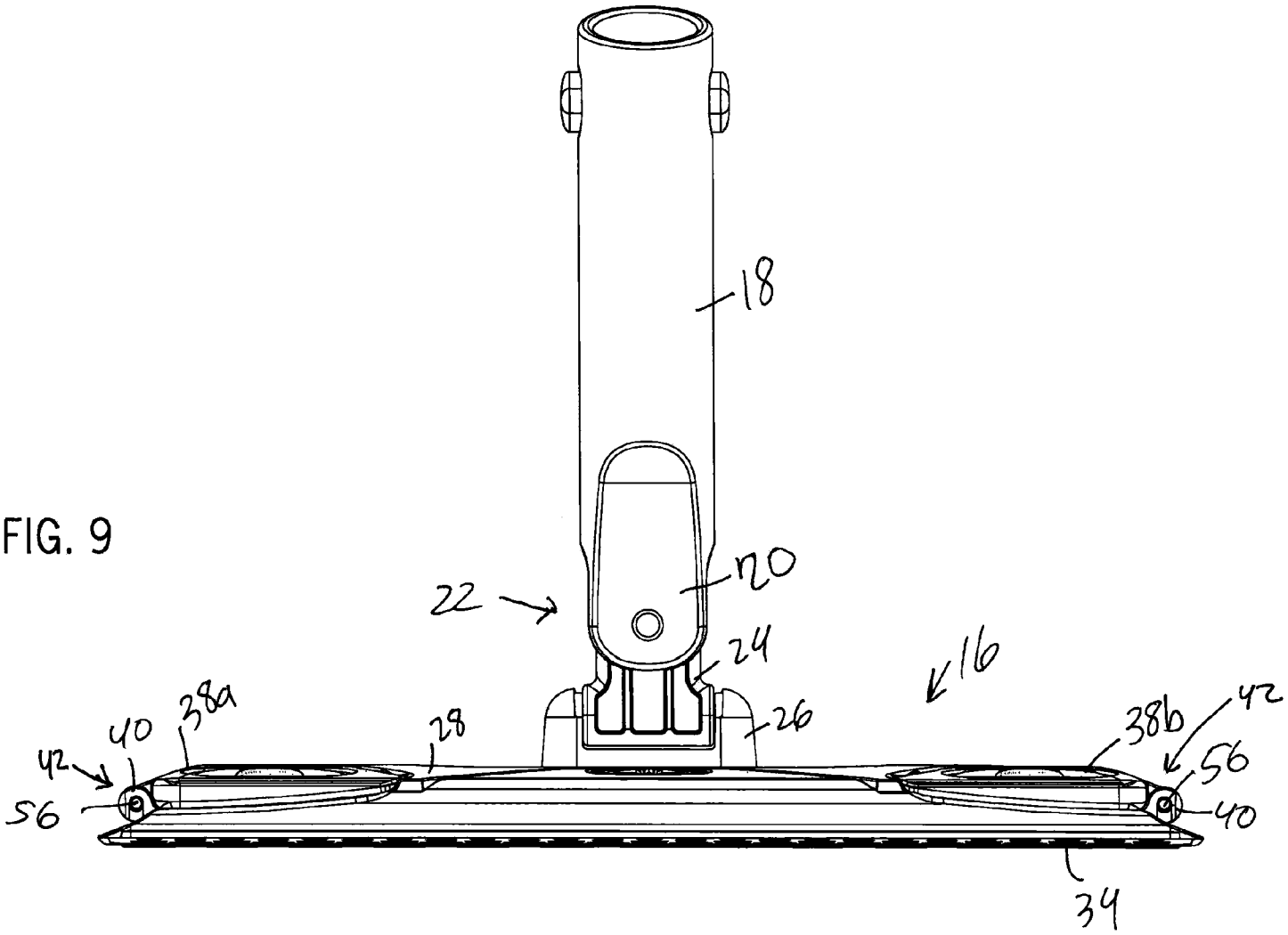
FIG. 9 is a front view of the head of FIG. 2.

Turning now FIGS. 3 and 7-8, the deployment elements 38*a*, 38*b* will be described. Besides having a mirrored structure, the deployment elements 38*a*, 38*b* are generally identical to each other. As such, only the deployment element 38*b* shown in FIGS. 7-8 will be described in detail.

The deployment element 38*b* has a substantially triangular perimeter. Inwardly of the perimeter, the deployment element 38*b* defines an oval passageway 50 to avoid contact with one of the cleaning wipe attachment elements when in the stowed position. One of the sides of the deployment element 38*b* (specifically, the hypotenuse side) includes a slot 52 for receiving one of the posts 48 of the upper base 28 to facilitate alignment with the upper base 28.

Another side of the deployment element 38*b* includes hinge elements 54. Together, the hinge elements 40, 54 support a pin 56 to define the hinge 42. The pin 56 supports a torsion spring 58 between the hinge elements 40, 54. The torsion spring 58 biases the deployment element 38*b* towards the deployed position. That is, the torsion spring 58 is relatively unloaded in the deployed position and relatively loaded in the stowed position. The deployment element 38*a* includes similar hinge elements 54 that together with the hinge elements 40 support a pin 56 to define the hinge 42. The pin 56 supports a torsion spring 58 between the hinge elements 40, 54. The torsion spring 58 biases the deployment element 38*a* towards the deployed position.

Referring now to FIGS. 3, 12, 13, 17, and 18, the bases 28 and 29 also supports a release mechanism 60 that holds the deployment elements 38*a*, 38*b* in the stowed position. The release mechanism 60 also facilitates, together with the torsion springs 58, relatively easy actuation and movement of the deployment elements 38*a*, 38*b* to the deployed position.

The release mechanism 60 includes a button 62 that extends upwardly through the base 28. The release mechanism 60 includes a lower base 63 (see FIG. 3). The button 62 is biased upwardly by a compression spring 64 disposed between the button 62 and the lower base 63. A user may press the button 62 to compress the spring 64 and displace the button 62 downwardly. This action causes flexible release arms 66*a*, 66*b* integrally connected to the sides of the button 62 to move downwardly, in part. That is, a lower portion 68*a*, 68*b* of each arm 66*a*, 66*b* moves downwardly and engages a different upwardly extending protrusion 70*a*, 70*b*. As such, each arm 66*a*, 66*b* pivots about the contact point with one of the protrusions 70*a*, 70*b*, which in turn causes a distal upper portion 72*a*, 72*b* of each arm 66*a*, 66*b* to move inwardly toward each other due to contact with the interior of the base 28.

Each upper portion 72*a*, 72*b* normally extends through a different hole 74 (see FIG. 4) in the upper base 28 and into depressions 76 (see FIGS. 7 and 8) in the deployment elements 38*a*, 38*b* to engage and thereby hold one of the deployment elements 38*a*, 38*b* in the stowed position. However, when the button 62 is pressed downwardly and ends of the upper arm portions 72*a*, 72*b* move inwardly, each upper arm portion 72*a*, 72*b* disengages the adjacent deployment element 38*a*, 38*b* and the torsion springs 58 move the deployment elements 38*a*, 38*b* to the deployed position.

One surface of each of the deployment elements 38*a*, 38*b* may include first fastener parts 41 of a hook and loop fastener system such as that sold under the tradename Velcro™. When the deployment elements 38*a*, 38*b* are in the stowed position, each first fastener part 41 faces away from the surface to be treated. See the first fastener parts 41 in the stowed position of the deployment elements 38*a*, 38*b* in FIGS. 2, 10 and 12. When the deployment elements 38*a*, 38*b* are in the deployed position, each first fastener part 41 faces the surface to be treated. The second fastener part of the hook and loop fastener system can be an outer layer of a disposable cleaning sheet such that the disposable cleaning sheet can be attached to each of the first fastener parts 41 that face the surface to be treated. The cleaning sheets 72 can comprise, for example, materials such as those described in PCT Patent Application Publication No. WO 02/00819. The attachable cleaning material is not limited to disposable cleaning sheets, but may also be a more durable material like a microfiber cloth, etc. The first fastener parts 41 may also attach other cleaning devices, such as a brush having a base with the second fastener part of the hook and loop fastener system attached or molded into the base.

The deployment elements 38*a*, 38*b* may be manually moved by a user from the deployed position to the stowed position. In this situation, the button 62 need not be pressed to avoid contact between the deployment elements 38*a*, 38*b* and the upper arm portions 72*a*, 72*b*. Instead, when a user rotates the deployment elements 38*a*, 38*b* toward the lower surfaces 44 (see FIG. 4), the deployment elements 38*a*, 38*b* engage and briefly push the upper arm portions 72*a*, 72*b* inwardly. That is, the upper arm portions 72*a*, 72*b* "cam" over the deployment elements 38*a*, 38*b* when the deployment elements 38*a*, 38*b* return to the stowed position. When the deployment elements 38*a*, 38*b* reach the stowed position, the upper arm portions 72*a*, 72*b* automatically move outwardly due to their flexibility and enter the holes 74 and the depressions 76 again holding the deployment elements 38*a*, 38*b* in the stowed position.

From the above description, it should be apparent that the cleaning device 10 includes a variable size and shape head 16. As such, the cleaning device 10 is advantageously appropriate for use in different cleaning situations.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides cleaning devices having variable size and shape heads for mounting disposable cleaning sheets.

All documents cited in the Detailed Description of the Invention are, in relevant part, incorporated herein by reference; the citation of any document is not to be construed as an admission that it is prior art with respect to the present invention.

What is claimed is:

1. A cleaning device comprising:

a base having a first side and an opposed second side;

a first deployment element pivotally connected to the first side of the base and pivotable from a first stowed position to a first deployed position;

a second deployment element pivotally connected to the second side of the base and pivotable from a second stowed position to a second deployed position;

a first biasing device engaging the base and the first deployment element, the first biasing device biasing the first deployment element towards the first deployed position;

a second biasing device engaging the base and the second deployment element, the second biasing device biasing the second deployment element towards the second deployed position; and a release mechanism including an actuator button and supported by the base, the actuator button including a first arm extending from a first side of the actuator button and a second arm extending from an opposing second side of the actuator button, the first arm engaging the first deployment element to hold the first deployment element in the first stowed position, the second arm engaging the second deployment element to hold the second deployment element in the second stowed position, wherein the actuator button is configured to pivot the first arm away from the first deployment element and the second arm away from the second deployment element to disengage both of the first deployment element and the second deployment element thereby permitting the first biasing device to move the first deployment element to the first deployed position and permitting the second biasing device to move the second deployment element to the second deployed position.

2. The cleaning device of claim 1 further comprising:

a foam layer positioned on the base.

3. The cleaning device of claim 2 wherein:

the foam layer includes surface protrusions.

4. The cleaning device of claim 3 wherein:

the surface protrusions are arranged in a plurality of lines.

5. The cleaning device of claim 4 wherein:

the surface protrusions have a larger surface area in a central line of the plurality of lines.

6. The cleaning device of claim 1 further comprising:

a plurality of attachment structures for retaining a cleaning sheet, the attachment structures being located on a top surface of the base.

7. The cleaning device of claim 6 wherein:

the attachment structures comprise a flexible material having slits defining pointed structures capable of engaging a cleaning sheet.

8. The cleaning device of claim 7, wherein at least one of the first deployment element includes a passageway for receiving one of the attachment structures when the first deployment element is in the first stowed position, or the second deployment element includes a passageway for receiving one of the attachment structures when the second deployment element is in the second stowed position.

9. The cleaning device of claim 1, wherein at least one of the first deployment element is flush with a top surface of the base when the first deployment element is in the first stowed position, or the second deployment element is flush with the top surface of the base when the second deployment element is in the second stowed position.

10. The cleaning device of claim 1 wherein:

the actuator button is configured to move a first end of the first arm toward a second end of the second arm when the button is depressed.

11. The cleaning device of claim 10 wherein:

the first end of the first arm engages the first deployment element when the first deployment element is in the first stowed position, and the second end of the second arm engages the second deployment element when the second deployment element is in the second stowed position.

12. The cleaning device of claim 1 wherein:

the first deployment element has a substantially triangular perimeter, and the second deployment element has a substantially triangular perimeter.

13. The cleaning device of claim 1, wherein at least one of the first deployment element includes a fastener for attaching a cleaning sheet, or the second deployment element includes a fastener for attaching a cleaning sheet.

14. The cleaning device of claim 1 wherein:

wherein, when the first deployment element is in the first stowed position and the second deployment element is in the second stowed position, the base, the first deployment element, and the second deployment element define a substantially rectangular perimeter, and when the first deployment element is in the first deployed position and the second deployment element is in the second deployed position, the base, the first deployment element, and the second deployment element define a substantially trapezoidal perimeter.

15. The cleaning device of claim 1 wherein:

when the first deployment element is in the first deployed position and the second deployment element is in the second deployed position, the base, the first deployment element, and the second deployment element define a perimeter having a leading edge and a trailing edge, the leading edge having a greater length than the trailing edge.

16. A cleaning device comprising:

a base having a first side and an opposed second side;

a first deployment element pivotally connected to the first side of the base and pivotable from a first stowed position to a first deployed position;

a second deployment element pivotally connected to the second side of the base and pivotable from a second stowed position to a second deployed position;

a first torsion spring for biasing the first deployment element to the first deployed position;

a second torsion spring for biasing the second deployment element to the second deployed position; and a release mechanism comprising (i) a first arm for engaging the first deployment element to hold the first deployment element in the first stowed position, and (ii) a second arm for engaging the second deployment element to hold the second deployment element in the second stowed position, and (iii) an actuator button, wherein the first arm is connected to a first side of the actuator button and the second arm is connected to a second opposing side of the actuator button, the actuator button configured to move a distal end of the first arm toward a distal end of the second arm when the button is depressed;

wherein, when the first deployment element is in the first stowed position and the second deployment element is in the second stowed position, the base, the first deployment element, and the second deployment element define a substantially rectangular perimeter, and wherein, when the first deployment element is in the first deployed position and the second deployment element is in the second deployed position, the base, the first deployment element, and the second deployment element define a substantially trapezoidal perimeter.

17. The cleaning device of claim 16, wherein the release mechanism is manually actuatable to disengage the first deployment element and disengage the second deployment element thereby permitting the first biasing device to move the first deployment element to the first deployed position and permitting the second biasing device to move the second deployment element to the second deployed position.

* * * * *